US005150560A

United States Patent [19]

Crowley

[11] Patent Number: 5,150,560

[45] Date of Patent: Sep. 29, 1992

[54] SYSTEM AND METHOD FOR MANUFACTURING ENVELOPES

[75] Inventor: H. W. Crowley, Newton, Mass.

[73] Assignee: Roll Systems, Inc., Burlington, Mass.

[21] Appl. No.: 714,232

[22] Filed: Jun. 12, 1991

[51] Int. Cl.[5] ..... B65B 11/48; B65B 61/02

[52] U.S. Cl. ..... 53/411; 53/131.5; 53/284.3; 53/430

[58] Field of Search ..... 53/411, 131.5, 131.4, 53/131.2, 460, 284.3, 55, 51, 77, 430, 118, 117; 493/188, 216, 198, 323, 324

[56] References Cited

U.S. PATENT DOCUMENTS

| | | | |
|---|---|---|---|
| 3,055,152 | 9/1962 | Williams | 53/411 |
| 4,707,790 | 11/1987 | Gomes et al. | 53/284.3 X |
| 4,733,856 | 3/1988 | Gunther, Jr. | 53/284.3 X |
| 4,890,439 | 1/1990 | Smart et al. | 53/411 X |
| 4,939,888 | 7/1990 | Katz et al. | 53/131.5 X |

*Primary Examiner*—James F. Coan
*Attorney, Agent, or Firm*—Wolf, Greenfield & Sacks

[57] ABSTRACT

A system and method for manufacturing printed envelopes provides feeding the web from a source roll into a laser printer. Predetermined envelope information such as address, name, and presort codes may be placed upon the web at selected locations thereon by the printer. The printed web is then output from the laser printer to an output roll. The printed web output roll is subsequently mounted onto an envelope folder in which each of the predetermined printed locations is detected. These predetermined locations are subsequently cut and the sheets derived therefrom are folded into individual envelopes. These envelopes are subsequently output to a collection point in a predetermined sequence. Prior to cutting and folding, additional enhancements such as embossing may be provided to the printed web.

35 Claims, 3 Drawing Sheets

MOUNT ROLL
10
CPU
16
14
22
LASER PRINTER
20
64
12
34
18
34
REMOVE ROLL WHEN COMPLETE
TRANSFER ROLL
24
(OR)
33
REMOUNT ROLL
TO CPU
25
26
28
64
18
OPTIONAL ENHANCEMENT (EMBOSSING)
64
27
12
34
34
18
REMOVE ROLL WHEN COMPLETE
TRANSFER ROLL
29
REMOUNT ROLL
TO CPU
30
32
40
64
18
ENVELOPE CUTTING AND FOLDING
38
64
SEQUENCED ENVELOPE COLLECTION
12
34
36

SYSTEM AND METHOD FOR MANUFACTURING ENVELOPES

FIELD OF INVENTION

This invention relates to a novel system and method for manufacturing envelopes and more particularly to a system and method involving roll-to roll preprinting of envelope web.

BACKGROUND OF INVENTION

In volume mailings, it is often desirable to produce individually addressed and marked envelopes. Large numbers of these envelopes may be produced in an average mailing, each of the envelopes requiring its own customized markings including address, date, postal presort and other requirements as well as bar coding for automatic processing.

In the past, processing of large number of individually marked envelopes has been accomplished by means of feeding either prefolded envelopes or precut unfolded blank sheets through a laser or other type of printer to add the necessary information. Then, the envelopes undergo final folding or finishing and subsequently, have the correct letters and other inserts added in a separate step. The address could alternatively be applied by means of ink jet or other similar printer once the envelope is completed and input to a letter inserting machine.

The disadvantage of the above described techniques is that each envelopes represents a loose sheet of paper, folded or otherwise, that must be tracked throughout the process. Misalignments or other losses of one or more of the sheets as the process progresses results in loss of the entire sequence for printing. If the sequence is lost, it becomes impossible to match each envelope to its proper position in the sequence. Thus, envelopes may become misaddressed or filled with the wrong letters, and, otherwise, may lose the proper zip code presort sequencing required by the post office in order to gain the advantage of lower presort rates.

If at some point in the process, foil or other decorative embossing is to be added to the envelopes, it may interfere with or become damaged by subsequent addressing and folding operations. Thus, proper sequencing and production becomes even more difficult owing to the need to subsequently emboss envelopes following addressing. This added step only serves to further raise the risk of sequencing loss.

Printing envelopes in connected form on a roll solves a number of potential sequencing problems. One previous attempt to produce envelopes from a roll of web has involved the production of a preprinted roll upon ordinary business form paper that is subsequently cut and formed into envelopes. Machines utilizing this method have only contemplated the use of business form presses to produce standardized envelopes prior to envelope forming.

SUMMARY OF INVENTION

It is therefore an object of the present unique invention to provide a system and method for manufacturing printed envelopes that allows programmable variation of information on a sequenced set of printed envelopes while still enabling tracking of each envelope.

It is another object of this invention to provide a system and method for manufacturing printed envelopes that utilizes variable information or laser printing of some or all print placed upon individual envelopes.

It is another object of this invention to provide a system and method for manufacturing printed envelopes that produces preprinted sections of web for use as envelopes that are stored in convenient roll form between production steps.

It is yet another object of this invention to provide a system and method for manufacturing printed envelopes that includes checking functions to ensure proper sequencing.

A system and method for manufacturing printed envelopes according to this invention provides feeding the web from a source roll into a laser printer or similar type of variable information printer. The printer adds predetermined information including address, postage and presort codes to programmed, or otherwise predetermined, locations upon the web. The printed web is then output from the laser printer into an output roll. The printed web may be subsequently mounted onto an embossing or similar enhancement device and then rerolled into a storage roll. This storage roll is then transferred to a folder cutter device that cuts the web into individual sheets at each of the programmed or otherwise predetermined locations and subsequently folds the sheets into envelopes. These envelopes may then be outputted to a collection point for insertion of contents and further operations. At all times, information sequencing is maintained by means of a central processing unit (CPU) and the sequence is not lost due to the fact that the envelopes remain processed in web form until they are ready for final insertion and shipping.

In one embodiment, finished envelopes may be stored in sequentially ordered boxes. In another embodiment, the envelopes may be rolled, using a roll core and opposing strap allowing quick unrolling for further operations and final shipping.

BRIEF DESCRIPTION OF THE DRAWINGS

The foregoing objects and other advantages will become apparent from the following detailed description of the preferred embodiments in which.

DETAILED DESCRIPTION OF THE PREFERRED EMBODIMENTS

Figure 1:
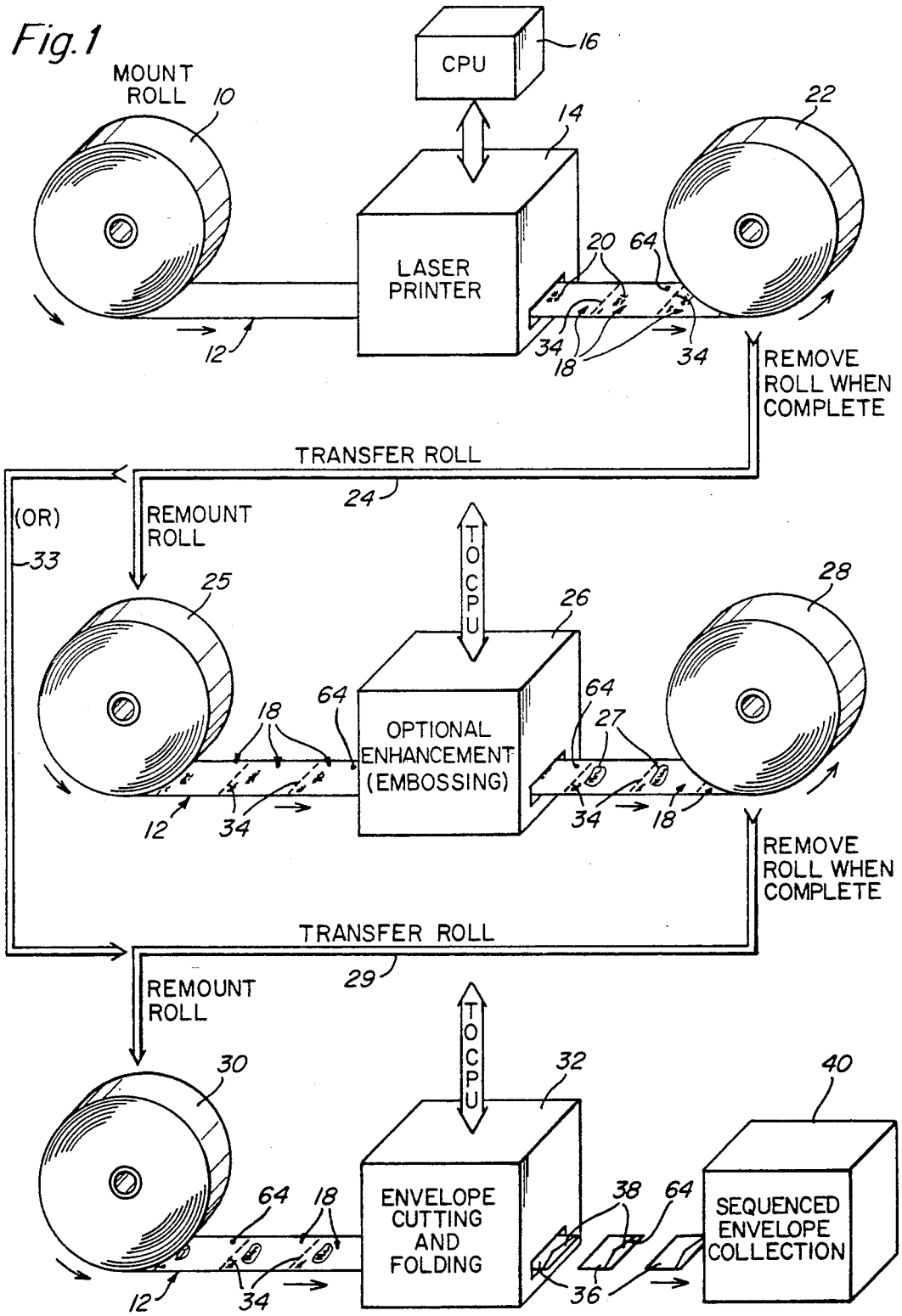
FIG. 1 is a schematic diagram of a system and method for manufacturing printed envelopes utilizing roll to-roll processing according to this invention.

FIG. 1 schematically illustrates a system and method for manufacturing printed envelopes according to this invention. Unlike traditional methods that first manufacture the envelope then print it and then finally emboss it, the depicted system begins with a roll 10 of unprinted web 12 (paper in this example). This roll 10 is fed continuously through a laser printer 14 that is interfaced with a CPU 16. The CPU 16 carries a programmed routine that sequentially instructs the laser (or similar variable information) printer 14 to lay down programmed, or otherwise predetermined, text at given web locations 18 as the web is passed through the laser printer 14. By variable information, it is meant a printer having readily alterable text format through, for example, a computer program. Such a printer generally utilizes toner to form print text on a sheet.

One advantage of utilizing a laser or other variable information printer is that it retains the ability to access all portions of the web presented to it with variable information. As such, the full body of the web may be printed upon. A further advantage is that the envelope size can be varied depending on the programmed plan for size and amount of subsequent inserts. An additional advantage is that postal rates (stamps) can be printed based on such items as size, weight of future contents, and postal discounts. A multiplicity of laser printers having a plurality of possible toner colors may be contemplated according to this invention each connected in unison to access a certain portion of the web as it is passed therethrouqh. Such accessing involves direct feedback (handshaking) with the CPU 16 which determines when a given location upon the web is presented to the particular laser printer. As illustrated, printing 20 is laid down upon the web 12 at programmed or otherwise predetermined intervals therealong. Each of these intervals corresponds to the sheet size necessary to fold each envelope.

Printing, as noted, may include a variety of information that is tailored to each individual envelope based upon stored CPU information relative to its contents. Additionally, the postage amount to be applied may be indicated thereon based upon weight, size, content and any applicable postal discounts.

Following the initial printing of web sections 18 by the laser printer unit(s), the continuous web 12 may be rerolled (22) at an output side of the printer 14 for convenient storage. At this point, the CPU 16 has stored therein an accurate record of the sequence of printed web sections contained on the storage roll 22. Of course, when the storage roll 22 is unwound again, the sequence will be reversed (i.e. last in first out). The CPU 16, may easily accommodate this reversal of order by inverting the order of its programmed sequence. An advantage of this system is that, despite sequence inversion, at no time does the sequence of web sections 18 become disordered since each section remains part of a continuous unbroken web 12.

The initial printed storage roll 22 is subsequently removed, according to this example, and transferred (24) to be remounted (25) onto an optional enhancement device 26. Such enhancements (27) may include further printing, embossing, cutting, imprinting, lithography, adhesive placement and application of foil to the sheet. Note, none of the web sections has yet been folded into an envelope which contrasts directly with conventional envelope construction in which the folding generally occurs first, rather than later, in the overall process. The enhancement device 26 may be linked with the CPU 16, or may otherwise examine particular text upon each web section 18, in order to determine (by comparing with sequenced programmed instructions) when that particular section is at the proper location within the enhancement device 26 and which type of enhancement, if any, is to be applied to that particular section. In any event, since the sequence is fixed by virtue of the continuous roll 22 of web, each web section may be accurately and individually a located and personalized with appropriate enhancements. Again, note that while one enhancement unit is depicted, several enhancement processes may be undertaken at once.

Subsequent to the enhancement process, the web is again taken up by a second storage roll 28 according to this example. The second storage roll 28 is then, similarly, transferred (29) to be remounted (30) upon an envelope sheet cutting and folding unit 32. As depicted in FIG. 1, the printed storage roll 22, without enhancements, could have been directly mounted (33) upon an envelope sheet cutting and folding unit 32 if no further enhancements were desired. The cutting and folding unit 32 is, again, adapted to detect (or recognize based upon feedback with the CPU indicating web position within the unit) section breaks 34 between various web 12 sheet sections 18 and cuts the web 12 at these locations 34. Each sheet is then folded into a completed envelope 36. Any adhesives applied during prior operations to hold the folded parts of the envelope together may also, at this point, be sealed. Since the envelope 36 has not been filled, however, the main flap 38 (if any) may remain unsealed in order to allow subsequent insertion of contents.

While envelopes depicted are generally of equal size, the CPU may be programmed to detect particular envelopes at cutting and folding locations for which odd-sized contents are to be inserted, those envelopes may then be formed to a different size depending upon the particular contents to be inserted.

Figure 2:
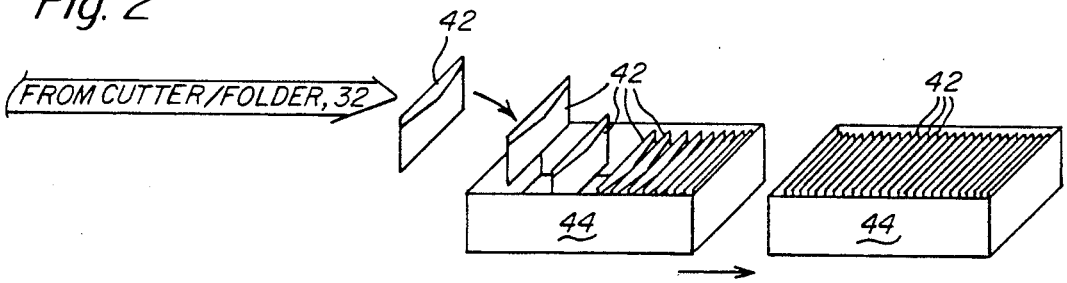
FIG. 2 is a somewhat schematic diagram of one embodiment of a system and method for packaging a plurality of completed folded envelopes produced using the system and method of FIG. 1 in sequential order according to this invention.

The completed envelopes 36 are then transferred to a unit 40 that stores them in a sequence corresponding to the original CPU 16 program sequence or its inverted analog. The particular completed envelope storage method may depend upon the number and size of envelopes to be stored. Examples of such storage patterns are depicted schematically in FIGS. 2 and 3 respectively. FIG. 2 illustrates the sequential storage of envelopes 42 in boxes 44. As envelopes 44 are outputted from the cutter/folder unit (32), they are inserted into a box 44. Each box 44, once full, is moved out of position relative to a box filler to be presented at an output location. The fullness of a box 44 may determined by the CPU 16 by counting the number of envelopes output and comparing this number to a maximum box capacity. Fullness may also be based upon a particular common characteristic shared by all envelopes in a set such as presort zip code. The final result in this instance is that each box is output in order containing therein envelopes also in their own sequential order.

Figure 3:
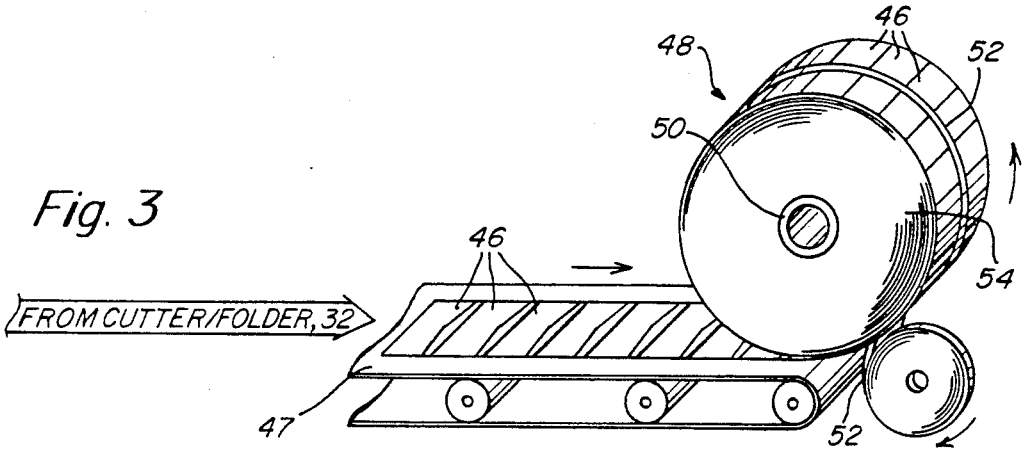
FIG. 3 is a alternative embodiment of a system and method for packing envelopes produced according to the system and method of FIG. 1 utilizing a roll and strap for storing a plurality of completed envelopes in sequence.
Figure 5:
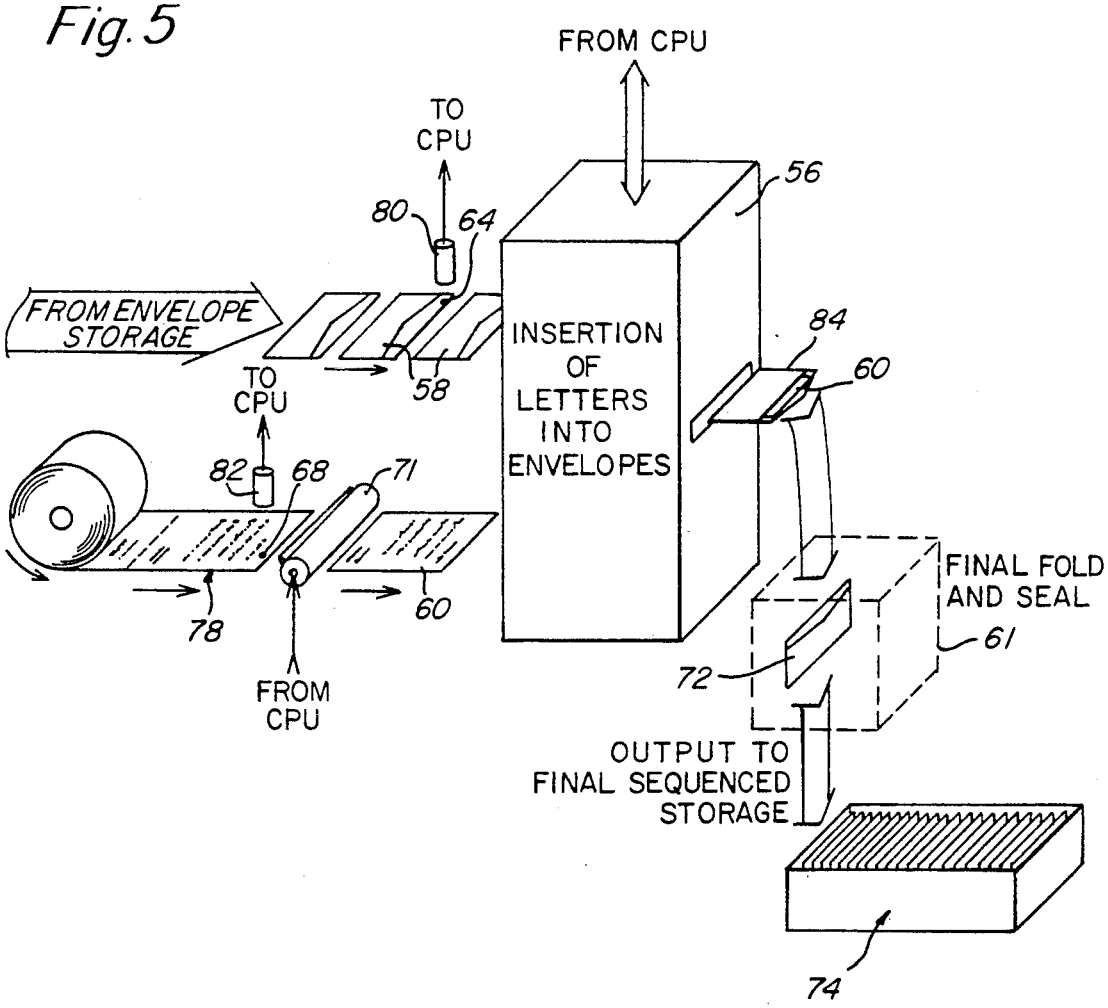
FIG. 5 is a schematic diagram of the tracking of envelopes and corresponding letters utilizing the check digits as shown in FIG. 4 for proper sequential insertion of the letters into respective envelopes according to this invention.

Alternatively, the stream of finished unfilled envelopes 46 sequentially output from the cutter/folder unit (32), may be conveyed (47) to a roll forming device 48 as depicted in FIG. 3. The roll forming device 48 utilizes a roll core 50 and an opposing reusable flexible (plastic) tape or strap 52 that is paid out to support the undersides of the envelopes 46 against the roll 54 as the roll advances. This roll 54 and the tape 52 incorporated therewith may be subsequently remounted onto a contents insertion machine 56 (FIG. 5) for quick output of the sequenced completed envelopes 58 for final insertion of letter contents 60 and sealing 61. The boxes 44 of FIG. 2 may otherwise be loaded onto an insertion machine 56 for sequenced output of their envelopes 42 into the insertion machine 56.

Figure 4:
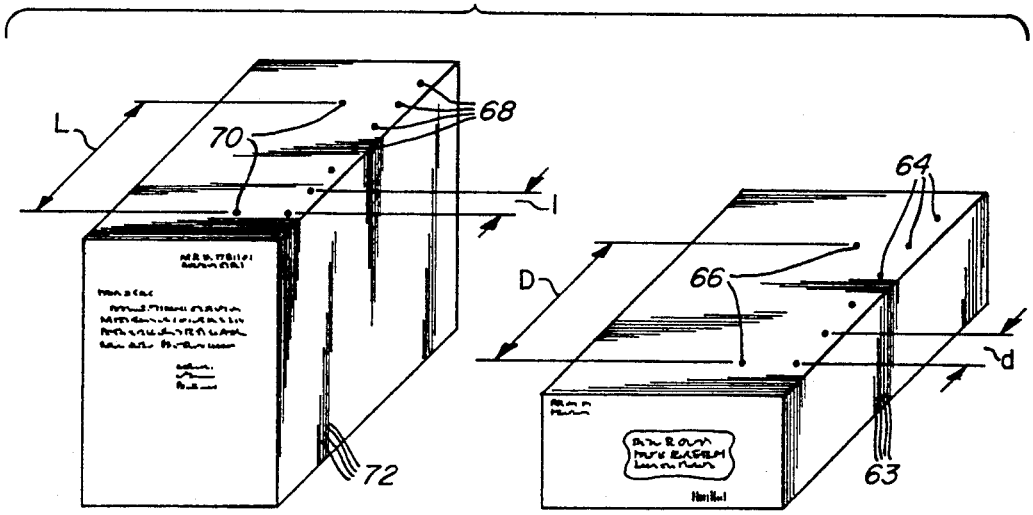
FIG. 4 is a somewhat schematic view detailing the positioning of printed check digits on envelopes and corresponding letters to be inserted into the envelopes that ensures proper sequencing according to this invention.

While the CPU 16 may effectively track the sequence of each web section and the subsequent corresponding folded envelope, it may desirable to provide secondary means for checking the proper sequencing of envelopes. To this end, the CPU 16 may instruct the laser printer 14 to apply specific markings at predetermined intervals to printed web sections. Such markings 64 are illustrated in FIG. 1. Additional secondary and even tertiary markings may be provided for larger multiples of intervals. For example, as depicted in FIG. 4, the envelopes 63 may include regularly spaced markings 64 every 10 envelopes (spacing d) and may also include secondary markings 66 every 50 envelopes (spacing D). The markings are, in this example, applied as part of the initial printing process when the sequence is first established and layed down. At any time thereafter, these markings may be scanned by detectors to insure that subsequent processes are proceeding in the correct sequence. If at any time the sequence is lost, the CPU 16 may be instructed to stop the system or otherwise indicate a loss of sequence so that corrective action may be taken. In this manner, an ongoing check and cross-check of sequencing is possible. Corresponding markings 68, 70 may be applied to letters 72 intended for insertion into particular envelopes 63 as also illustrated in FIG. 4. These markings 68, 70 may again denote, respectively, 10 letter intervals (spacing 1) and secondarily denote 50 letter intervals (spacing L).

The markings upon letters and envelopes particularly assist in ensuring proper insertion of letters into envelopes. Such a process, as discussed above, is depicted in FIG. 5. Finished envelopes 58 are transferred to an insertion unit 56. Simultaneously, letters 60 that in this example are cut (71) from a continuous web 78 thereof in response to CPU instructions, are also fed into the insertion unit 56. Both the letters 60 and envelopes 58 undergo a scan by respective detectors 80, 82 to ensure that the proper sequence of letters 60 and envelopes 58 is maintained. In the insertion unit 56 each corresponding letter 60 is then placed into an envelope 58. The filled envelopes 84 are then subsequently sealed by either the insertion unit 56 or another device (61) and then the final filled and sealed sequenced envelope 72 is boxed, rolled or otherwise stored in final output form 74 that maintains the appropriate sequence (box, strap/roll, etc.). This sequence, as noted, may be structured in such a way as to facilitate adherence to the postal service presort requirements or other predetermined parameters.

This unique process allows a wide range of previously impossible customizations of an envelope and its contents while facilitating rapid processing of large volumes of envelopes. The types and combinations of customization are limitless in the pursuit of a unique item to attract or accommodate an individual's or postal service needs.

It should be understood that the foregoing description of the invention is intended merely to be illustrative of the preferred embodiments and that other embodiments, modifications and equivalents may be apparent to those skilled in the art without departing from the spirit and scope of this invention.

What is claimed is:

1. A method for manufacturing printed envelopes comprising the steps of:

feeding web from a source roll into a variable information printer;

printing envelope information by means of a variable information printer on selected consecutive locations of the web;

outputting the web from the printer to an output roll;

re-orienting the output roll so that the web may be unrolled;

subsequent to outputting, cutting and folding individual envelopes from the output roll in response to detection of the locations; and directing the envelopes to a collection point in a predetermined sequence, the envelope being formed into sequenced bundles of predetermined size, the bundles being contained by a containing means to enable transfer to a contents insertion location.

2. A method as set forth in claim 1 further comprising performing, subsequent to reorienting the output roll and prior to cutting and folding, further enhancements to the web at predetermined of the locations in response to detection of the locations as the web is removed from the output roll and replacing the web onto an output roll.

3. A method as set forth in claim 1 further comprising inserting contents into each of the envelopes in an order corresponding to the predetermined sequence of envelopes at the collection point.

4. A method as set forth in claim 3 wherein the step of printing includes placing marks on the web at predetermined of the locations at intervals, the locations being readable by a detector.

5. A method as set forth in claim 4 wherein predetermined of the contents include corresponding marks thereon at intervals corresponding to the regular intervals between marks on the web, the step of inserting including comprising the marks of the web and the corresponding marks of the contents as the contents are each inserted into the envelopes.

6. A method as set forth in claim 1 wherein the step of printing further comprises placing marks upon the web at predetermined of the locations positioned at regular spacings, the marks being readable by a detector.

7. A method as set forth in claim 6 wherein the detection of locations includes recognizing marks read by the detector.

8. A method as set forth in claim 5 wherein the step of comparing includes generating an out-of-order signal if marks on the web and corresponding marks on the contents are not each detected at proper intervals relative to one another upon insertion of contents into envelopes.

9. A method for manufacturing printed envelopes comprising the steps of:

feeding web from a source roll into a variable information printer;

printing envelope information by means of a variable information printer on selected consecutive locations of the web;

outputting the web from the printer to an output roll;

re-orienting the output roll so that the web may be unrolled;

subsequent to outputting, cutting and folding individual envelopes from the output roll in response to detection of the locations;

directing the envelope to a collection point in a predetermined sequence; and performing, subsequent to re-orienting the output roll and prior to cutting and folding, further enhancements to the web at predetermined of the locations in response to detection of the locations as the web is removed from the output roll and replacing the web onto an output roll, wherein the enhancements include at least one of embossing, adhesive application, imprinting, further printing, and application of decorative foil.

10. A method for manufacturing printed envelopes comprising the steps of:

feeding web from a source roll into a variable information printer;

printing envelope information by means of a variable information printer on selected consecutive locations of the web;

outputting the web from the printer to an output roll;

re-orienting the output roll so that the web may be unrolled;

subsequent to outputting, cutting and folding individual envelopes from the output roll in response to detection of the locations; and directing the envelopes to a collection point in a predetermined sequence, wherein the step of directing includes loading at least one box with envelope in a sequential order.

11. A method as set forth in claim 10 wherein the step of loading includes filling a plurality of boxes with envelopes in order and each of the boxes being oriented in order.

12. A method for manufacturing printed envelopes comprising the steps of:

feeding web from a source roll into a variable information printer;

printing envelope information by means of a variable information printer on selected consecutive locations of the web;

outputting the web from the printer to an output roll;

re-orienting the output roll so that the web may be unrolled;

subsequent to outputting, cutting and folding individual envelopes from the output roll in response to detection of the locations; and directing the envelopes to a collection point in a predetermined sequence, wherein the steps of directing includes forming the envelopes into a roll with an opposing strap for support.

13. A system for manufacturing printed envelopes comprising:

means for printing envelope information at predetermined locations on a continuous web;

means for placing enhancements at the location on the web subsequent to printing;

means for cutting and folding the web into the shape of envelopes at each of the locations subsequent to the application of enhancements;

roll support and roll transfer means for storing the web in roll form including means for paying out and taking up the web on rolls during each process performed on the web;

means for tracking each of the locations to maintain a programmed sequence; and means for collecting cut and folded envelopes into bundles having the programmed sequence, the means for collecting including container means for allowing the transfer of the envelopes to a location for insertion of contents thereto.

14. A system as set forth in claim 13 wherein the means for tracking includes a central processing unit interconnected with at least the means for printing, for storing processing information in a programmed sequence.

15. An system as set forth in claim 14 wherein the means for tracking further includes detector means for reading marks positioned at intervals upon the web by the means for printing.

16. A system as set forth in claim 15 further comprising means for inserting contents into each of the envelopes subsequent to cutting and folding.

17. A system as set forth in claim 16 wherein the contents include, at corresponding intervals thereon, corresponding marks that are readable by a detector.

18. A system as set forth in claim 17 wherein the means for tracking includes means for comparing the marks on the web to corresponding marks on the contents to determine whether each of the contents are being inserted into each of the envelopes in a predetermined order.

19. An system as set forth in claim 13 further comprising envelope storage means for storage of envelopes subsequent to cutting and folding.

20. A system as set forth in claim 13 wherein an envelope size is varied based upon at least one of an amount and size of contents to be inserted thereinto.

21. A system as set forth in claim 13 wherein a printed postage amount upon the envelope is varied based upon at least one of an amount, size and postage discount that may apply to each envelope individually.

22. A system for manufacturing printed envelopes comprising:

means for printing envelope information at predetermined locations on a continuous web;

means for placing enhancements at the locations on the web subsequent to printing, wherein the enhancement include at least one of embossing, cutting, further printing, adhesive application and application of foil;

means for cutting and folding the web into the shape of envelopes at each of the locations subsequent to the application of enhancements;

roll support and roll transfer means for storing the web in roll form including means for paying out and taking up the web on rolls during each process performed on the web;

means for tracing each of the locations to maintain a programmed sequence;

23. A system for manufacturing printed envelopes comprising:

means for printing envelope information at predetermined locations on a continuous web;

means for placing enhancements at the locations on the web subsequent to printing;

means for cutting and folding the web into the shape of envelopes at each of the locations subsequent to the application of enhancements;

roll support and roll transfer means for storing the web in roll form including means for paying out and taking up the web on rolls during each process performed on the web;

means for tracking each of the locations to maintain a programmed sequence; and envelope storage means for storing of envelopes subsequent to cutting and folding wherein the envelope storage means comprises means for loading boxes with envelopes in order, each of the boxes being output in order.

24. A system for manufacturing printed envelopes comprising:

means for printing envelope information at predetermined locations on a continuous web;

means for placing enhancements at the locations on the web subsequent to printing;

means for cutting and folding the web into the shape of envelopes at each of the locations subsequent to the application of enhancements;

roll support and roll transfer means for storing the web in roll form including means for paying out and taking up the web on rolls during each process performed on the web;

means for tracking each of the locations to maintain a programmed sequence; and envelope storage means for storage of envelopes subsequent to cutting and folding, wherein the envelope storage means includes roll and a continuous support means, each of the envelopes being held against the roll by opposing bias of the support means.

25. A method for manufacturing printed envelopes comprising the steps of:

directing a continuous web from a source through a variable printing device that places information at programmed locations upon the web in a predetermined sequence;

directing the printed web into an output roll;

transferring and remounting the output roll so that the printed web passes through an enhancement device for applying additional information and markings to selected of the programmed locations upon the web;

directing the web from the enhancement device to a second output roll;

transferring the second output roll from the enhancement device and cutting and folding individual envelopes from each of the programmed locations upon the web; and collecting the individual envelopes in a sequence in a container that maintains the sequence and that allows transfer of the individual envelopes for contents insertion thereinto.

26. A method as set forth in claim 25 further comprising tracking the programmed locations at predetermined intervals;

recording the tracked intervals; and inserting corresponding contents into each of the individual envelopes based upon the recorded tracked intervals;

27. A method as set forth in claim 26 wherein the step of tracking includes reading markings applied by the printing device at the tracked intervals.

28. A method for manufacturing printed envelopes comprising the steps of:

directing a continuous web from a source through a variable printing device that places information at programmed locations upon the web;

transferring the web from the printing device to an enhancement device for applying additional information and markings to selected of the programmed locations upon the web;

transferring the web from the enhancement device and cutting and folding individual envelopes from each of the programmed locations upon the web; and collecting the individual envelopes in a sequence in a container that maintains the sequence and the allows transfer of the individual envelopes for contents insertion thereinto.

29. The method as set forth in claim 28 wherein the enhancement device enables application of at least one of embossing, further printing, foil application, adhesive application and imprinting.

30. The method as set forth in claim 28 wherein the step of collecting includes loading the envelopes into at least one box.

31. The method as set forth in claim 28 wherein the step of collecting includes loading the envelopes into a roll wherein the envelopes are held therein by an opposing strap.

32. The method as set forth in claim 28 further comprising, transferring the collected envelopes to a contents insertion device and inserting contents into each of the envelopes.

33. The method as set forth in claim 32 wherein the step of inserting includes tracking the contents relative to the envelopes so that selected contents are inserted into each of the envelopes.

34. The method as set forth in claim 33 wherein the step of tracking includes reading marks positioned on selected envelopes at programmed intervals and comparing the marks to corresponding marks positioned on the contents at programmed intervals.

35. The method as set forth in claim 34 wherein the step of comparing includes signalling when the mark of an envelope does not match the mark of a corresponding contents.

* * * * *